United States Patent [19]

Inabata

[11] Patent Number: 4,737,046

[45] Date of Patent: Apr. 12, 1988

[54] CORE MEMBER FOR PLATEN ROLL

[75] Inventor: Yoshiko Inabata, Tokyo, Japan

[73] Assignee: Inabata Techno Loop Corporation, Tokyo, Japan

[21] Appl. No.: 810,691

[22] Filed: Dec. 18, 1985

[30] Foreign Application Priority Data

Jun. 27, 1985 [JP] Japan ..... 60-97910[U]

[51] Int. Cl.[4] ..... B41J 11/053

[52] U.S. Cl. ..... 400/661; 400/689

[58] Field of Search ..... 400/661, 661.1, 659, 400/661.2, 661.3, 661.4, 648, 660, 662, 689

[56] References Cited

U.S. PATENT DOCUMENTS

| | | | |
|---|---|---|---|
| 589,663 | 9/1897 | Mengis | 400/661.2 |
| 1,116,395 | 11/1914 | Dowd | 400/661.3 |
| 2,266,275 | 12/1941 | Schuler | 400/661 |
| 3,393,789 | 7/1968 | Keiter | 400/659 |
| 4,453,848 | 6/1984 | Adkisson et al. | 400/661 |

FOREIGN PATENT DOCUMENTS

| | | | |
|---|---|---|---|
| 692775 | 6/1940 | Fed. Rep. of Germany | 400/661.3 |
| 3406836 | 8/1984 | Fed. Rep. of Germany | 400/661 |

*Primary Examiner*—Charles A. Pearson

*Attorney, Agent, or Firm*—Wenderoth, Lind & Ponack

[57] ABSTRACT

A platen roll core member including an axle part, an external tube part coaxially disposed around the axle part and webs extending therebetween having a plurality of projections formed by at least one surface extending rectilinearly in the axial direction and integrally formed on either the outer surface of the axle part, on the inner surface of the external tube part or on both the outer surface of the axle part and the inner surface of the external tube part. Striking sounds generated as the platen roll core member is struck from outside make irregular reflections within a cavity of the core member due to the plurality of projections which results in quieter operation of the platen roll.

24 Claims, 2 Drawing Sheets

CORE MEMBER FOR PLATEN ROLL

FIELD OF THE INVENTION AND RELATED ART STATEMENT

The present invention relates to a core member of a platen roll used for an office printer, copier, typewriter, etc.

Recently, along with the development of a hard aluminum alloy and progress in the art of extrusion forming this aluminum alloy, a platen roll having light weight and a high degree of core accuracy can be produced. As an example, such a platen roll is disclosed in U.S. Pat. No. 4,453,848. This platen roll comprises, as shown in FIG. 1 and FIG. 2, a platen roll core member 1 formed by extruding a hard aluminum alloy and a rubber cover layer 2 which is placed over an external circumferential surface of the core member 1, and the shape of the platen roll core member 1 is formed such that it has an axle part 1*a*, an external tube part 1*b* and three radially extending webs 1*c* which connect the external tube part 1*b* and the axle part 1*a*, wherein the external tube part 1*b* and the webs 1*c* at opposite ends of the core member 1 are cut and removed, further the exposed axle part 1*a* and each opposite end is fabricated by cutting to form an assembly axle part 2, thus making a platen roll shown in the drawing. A platen roll core member 1 having such a structure with its external tube part 1*b*, the axle part 1*a* and the webs 1*c* formed integrally by an extrusion forming process, has an advantage in the accuracy is enhanced yet the weight thereof can be reduced since it is made of a hard aluminum alloy, but it has the following drawback on the other hand. That is, there is a structural drawback in that a platen roll using this platen roll core member 1 produced noise due to a striking sound from impact on a surface of the platen roll which echoes within an internal hollow part of the platen roll core member 1.

OBJECT AND SUMMARY OF THE INVENTION

The present invention overcomes the above-mentioned drawback by preventing the noise caused by striking, and further, the platen roll core member can be formed by sintering materials such as alumina, etc., or it can be made of synthetic resin, and compound material comprising synthetic resin and carbon fiber, etc. which when used as the raw materials in place of the aluminum alloy, reduces the cost of the platen roll core member. The core member according to the present invention comprises an axle part, an external tube part concentrically formed with the axle part, and webs which integrate the axle part and the external tube part, and further, a plurality of projections are provided extending in the axial direction on either or both of an external circumferential surface of the axle part and an internal circumferential surface of the external tube part.

DETAILED DESCRIPTION OF THE INVENTION.

Now, the present invention will be explained in detail with reference to the embodiments shown in FIGS. 3 to 7.

Figure 1:
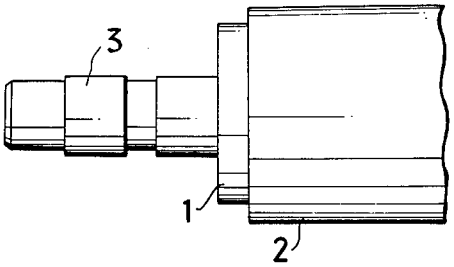
FIG.1 PRIOR ART
FIG. 1 shows part of a conventional platen roll structure.
Figure 2:
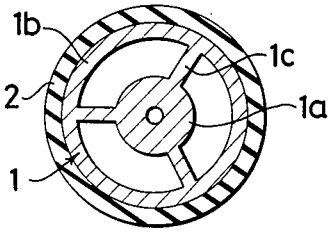
FIG.2 PRIOR ART
FIG. 2 shows a cross section of the platen roll shown in FIG. 1.
Figure 3:
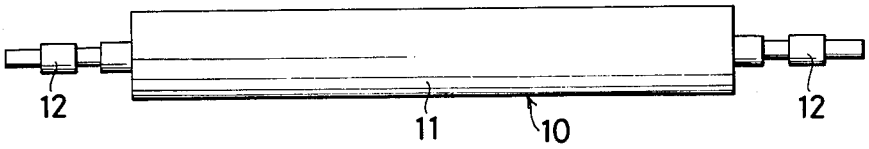
FIG. 3 is a plan view showing an embodiment of a core member of a platen roll according to the present invention.
Figure 4:
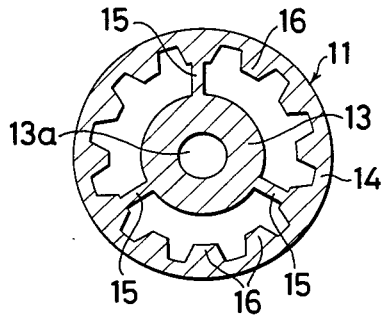
FIG. 4 is a cross-sectional view taken along the line A'A of FIG. 3.

FIG. 3 is a plan view showing an embodiment of a platen roll core member according to the present invention. Figs. 4 to 7 show several embodiments of cross-sectional views of platen roll core members of the present invention, wherein a platen roll core member 10 is formed by extruding suitable sintering materials, such as alumina, etc., thus forming a core body 11 of a tubular shape having air spaces therein which are open at opposite ends thereof, and after molding assembling axle parts 12, 12 at opposite ends thereof the structure is completed by sintering.

All of the platen roll core members 10 are integrally formed in such a manner that their core bodies 11 comprise axle parts 13 of generally cylindrical shape and extending in an axial direction, each having an axially extending hole 13a, external tube parts 14 of tubular shape coaxially disposed around the axle parts 13 such that a radially inner surface of the external tube part is spaced from a radially outer surface of the axle part, and a plurality of radially extending webs 15 which extend between the inner surface of the external tube part 14 and the outer surface of the axle part 13 at three evenly spaced angular positions. The platen roll core member 11 according to the first embodiment shown in FIG. 4, includes sound dampening means comprising a plurality of projections 16 each of which is formed by at least one surface extending rectilinearly in the axial direction, such as by three surfaces forming a trapezoidal cross-sectional shape taken in a plane which is perpendicular to the axial direction and each being integrally formed on the radially inner circumferential surface of the external tube part 14, the projections 16 being uniformly spaced in the circumferential direction and having a radially innermost part thereof spaced from the outer surface of the axle part.

Figure 5:
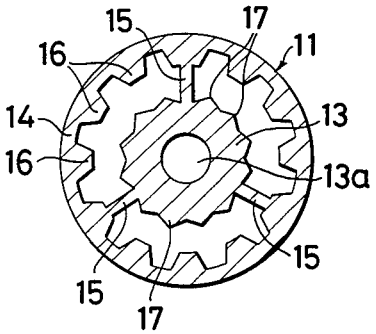
FIGS. 5, 6, 7(*a*) and 7(*b*) are cross-sectional views showing different embodiments of the core members of the platen rolls according to the present invention.

In a second embodiment, as shown in FIG. 5, in addition to the projections 16 the sound dampening means further includes projections 17 each having a V-shape formed by two surfaces extending rectilinearly in the axial direction and which are integrally formed on the radially outer circumferential surface of the axle part 13, the projections 17 being uniformly spaced in the circumferential direction and having a radially outermost part thereof spaced from the inner surface of the external tube part.

Figure 6:
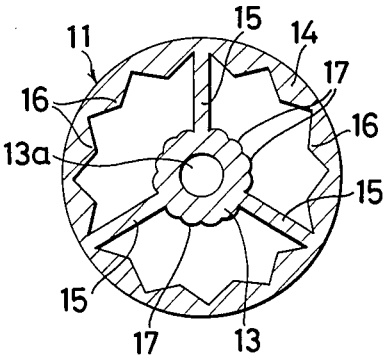
Figure 7A:
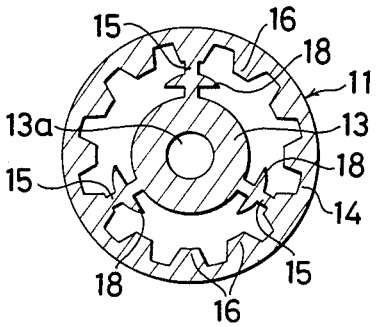
Figure 7B:
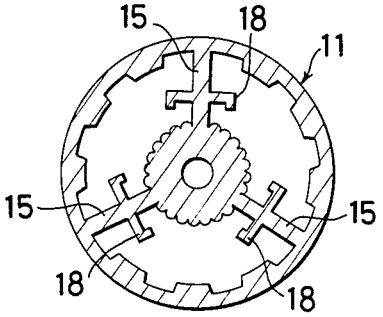

A third embodiment is shown in FIG. 6 wherein the above-mentioned projections 16 of a trapezoidal cross-sectional shape are replaced with projections having a V-shape, and also the projections 17 of the V-shape are replaced with semi-circular projections, each of which is formed by one surface extending rectilinearly in the axial direction. Thus, the above-mentioned projections 16 and 17 are not limited to these particular shapes. Also, as shown in FIGS. 7(*a*) and 7(*b*), fins 18 may be integrally provided on the webs 15. As shown in FIG. 7(*a*) each of the fins 18 has a flat surface facing the axle part 13 and a semi-circular surface facing the external tube part 14, whereas the fins 18 shown in FIG. 7(*b*) each include a pair of first linear portions extending perpendicularly from the webs and second linear portions, each extending perpendicularly from the first linear portions in a direction towards the axle part 13.

As has been explained above, according to the present invention, the platen roll core member body 11 has sound dampening means comprising a plurality of projections formed by at least one surface extending rectilinearly in the axial direction and integrally formed at either or both the external surface of the axle part 13 and the internal surface of the external tube part 14, whereby striking sounds generated as the platen roll core member is struck from outside make irregular reflections within a cavity of the core member 10 by the above-mentioned projections, thus being absorbed or damped. In addition, when fins 18 are provided on the webs 15 as shown in FIG. 7, the irregular reflections of the striking sounds increase, thus further improving the sound preventing effect, and furthermore when the core member 10 is formed from a porous sintering material, the sound preventing effect is still further improved.

Thus, the platen roll core member 10 can be formed using such sintering materials such as alumina, etc., and after the assembling axle parts 12, 12 are integrally formed at both ends of the core member body 11, the core member is completed by sintering. Since secondary fabrication such as cutting, etc., becomes unnecessary, the invention achieves the effect of reducing cost in production of the platen roll core member.

While the core member body 11 and the assembling axle parts 12, 12 are integrally formed in the above-mentioned embodiment, an assembling axle part 12 which is formed of steel or aluminum, etc., may be inserted into both ends of a core member body 11 after the body 11 is sintered.

Also, the core member 10 of the above-mentioned embodiment may be made by using sintering materials such as alumina, etc., as the raw material thereof which produces a sound damping effect from the material itself while reducing a unit cost of production. However, a synthetic resin such as polyacetal, polycarbonate, polymide, fluororesin, etc., may be used instead for forming the platen roll core member by injection molding, etc., or the platen roll core member may be formed from a composite or compound material which combines these synthetic resins with a reinforcing material such as metallic fiber, carbon fiber, etc.

Therefore, according to the present invention, since striking sounds generated as the core member of the platen roll is struck from outside are damped by the projections, a sound prevention effect as a result of absorbing sound or damping sound can be obtained.

Also, since inexpensive sintering material, synthetic resin or a compound material combining synthetic resin and reinforming material can be used as the raw material for a core member, it is possible to reduce the cost of the product.

I claim:

1. A core member for a platen roll comprising:

an axle part of generally cylindrical shape and extending in an axial direction;

an external tube part of tubular shape and extending in said axial direction, said external tube part being coaxially disposed around said axle part with a radially inner surface of said external tube part being spaced from a radially outer surface of said axle part;

a plurality of webs extending in said axial direction from one end of said core member to the other end of said core member, each of said webs extending radially between said inner surface of said external tube part and said outer surface of said axle part; and sound dampening means disposed on said inner surface of said external tube part for reducing noise due to sounds generated by striking an outer surface of said core member, said sound dampening means comprising a plurality of projections, each of which is formed by at least one surface extending rectilinearly in said axial direction, each of said projections having a radially innermost part thereof spaced from said outer surface of said axle part, said axle part, said external tube part, said webs and said projections being integrally formed in one piece from the same material with air spaces formed between said axle part, said external tube part and said webs being open at opposite ends of said core member.

2. The core member of claim 1, further comprising fins disposed on said webs, each of said fins having at least one linear portion extending perpendicularly from a respective one of said webs.

3. The core member of claim 1, further comprising fins disposed on said webs, each of said fins having a pair of first linear portions extending perpendicularly from a respective one of said webs and second linear portions, each of which extends perpendicularly from a respective one of said first linear portions in a direction towards said axle part.

4. The core member of claim 1, wherein said material is selected from the group consisting of aluminum alloy, sintering material, synthetic resin, composite of synthetic resin and metallic fiber, composite of synthetic resin and carbon fiber and composite of synthetic resin and reinforcing fiber.

5. A core member for a platen roll comprising:

an axle part of generally cylindrical shape and extending in an axial direction;

an external tube part of tubular shape and extending in said axial direction, said external tube part being coaxially disposed around said axle part with a radially inner surface of said external tube part being spaced from a radially outer surface of said axle part;

a plurality of webs extending in said axial direction, each of said webs extending radially between said inner surface of said external tube part and said outer surface of said axle part; and sound dampening means disposed on said inner surface of said external tube part for reducing noise due to sounds generated by striking an outer surface of said core member, said sound dampening means comprising a plurality of projections, each of which is formed by at least one surface extending rectilinearly in said axial direction, each of said projections having a radially innermost part thereof spaced from said outer surface of said axle part, each of said projections having a trapezoidal cross-sectional shape formed by three surfaces extending rectilinearly in said axial direction, said trapezoidal cross-sectional shape being taken in a plane which is perpendicular to said axial direction.

6. A core member for a platen roll comprising:

an axle part of generally cylindrical shape and extending in an axial direction;

an external tube part of tubular shape and extending in said axial direction, said external tube part being coaxially disposed around said axle part with a radially inner surface of said external tube part being spaced from a radially outer surface of said axle part;

a plurality of webs extending in said axial direction, each of said webs extending radially between said inner surface of said external tube part and said outer surface of said axle part; and sound dampening means disposed on said inner surface of said external tube part for reducing noise due to sounds generated by striking an outer surface of said core member, said sound dampening means comprising a plurality of projections, each of which is formed by at least one surface extending rectilinearly in said axial direction, each of said projections having a radially innermost part thereof spaced from said outer surface of said axle part, said sound dampening means further comprising fins disposed on said webs, each of said fins having a flat surface facing said axle part and a semi-circular surface facing said external tube part.

7. A core member for a platen roll comprising:

an axle part of generally cylindrical shape and extending in an axial direction;

an external tube part of tubular shape and extending in said axial direction, said external tube part being coaxially disposed around said axle part with a radially inner surface of said external tube part being spaced from a radially outer surface of said axle part;

a plurality of webs extending in said axial direction, each of said webs extending radially between said inner surface of said external tube part and said outer surface of said axle part; and sound dampening means disposed on said inner surface of said external tube part for reducing noise due to sounds generated by striking an outer surface of said core member, said sound dampening means comprising a plurality of projections, each of which is formed by at least one surface extending rectilinearly in said axial direction, each of said projections having a radially innermost part thereof spaced from said outer surface of said axle part, each of said projections being formed by two surfaces extending rectilinearly in said axial direction, said two surfaces forming a V-shaped cross-sectional shape taken in a plane perpendicular to said axial direction.

8. A core member for a platen roll comprising:

an axle part of generally cylindrical shape and extending in an axial direction;

an external tube part of tubular shape and extending in said axial direction, said external tube part being coaxially disposed around said axle part with a radially inner surface of said external tube part being spaced from a radially outer surface of said axle part;

a plurality of webs extending in said axial direction, each of said webs extending radially between said inner surface of said external tube part and said outer surface of said axle part; and sound dampening means disposed on said outer surface of said axle part for reducing noise due to sounds generated by striking an outer surface of said core member, said sound dampening means comprising a plurality of projections, each of which is formed by at least one surface extending rectilinearly in said axial direction, each of said projections having a radially outermost part thereof spaced from said inner surface of said external tube part.

9. The core member of claim 8 further comprising fins disposed on said webs, each of said fins having a flat surface facing said axle part and a semi-circular surface facing said external tube part.

10. The core member of claim 8, further comprising fins disposed on said webs, each of said fins having at least one linear portion extending perpendicularly from a respective one of said webs.

11. The core member of claim 8, further comprising fins disposed on said webs, each of said fins having a pair of first linear portions extending perpendicularly from a respective one of said webs and second linear portions, each of which extends perpendicularly from a respective one of said first linear portions in a direction towards said axle part.

12. The core member of claim 8, wherein each of said projections is formed by two surfaces extending rectilinearly in said axial direction, said two surfaces forming a V-shaped cross-sectional shape taken in a plane perpendicular to said axial direction.

13. The core member of claim 8, wherein each of said projections is formed by one surface extending rectilinearly in said axial direction, said one surface forming a semi-circular cross-sectional shape taken in a plane perpendicular to said axial direction.

14. The core member of claim 8, wherein said axle part, said external tube part, said webs and said projections are integrally formed in one piece from the same material with air spaces formed between said axle part, said external tube part and said webs being open at opposite ends of said core member.

15. The core member of claim 14, wherein said material is selected from the group consisting of aluminum alloy, sintering material, synthetic resin, composite of synthetic resin and metallic fiber, composite of synthetic resin and carbon fiber and composite of synthetic resin and reinforcing fiber.

16. A core member for a platen roll comprising:

an axle part of generally cylindrical shape and extending in an axial direction;

an external tube part of tubular shape and extending in said axial direction, said external tube part being coaxially disposed around said axle part with a radially inner surface of said external tube part being spaced from a radially outer surface of said axle part;

a plurality of webs extending in said axial direction, each of said webs extending radially between said inner surface of said external tube part and said outer surface of said axle part; and sound dampening means disposed on said inner surface of said external tube part and on said outer surface of said axle part for reducing noise due to sounds generated by striking an outer surface of said core member, said sound dampening means comprising a plurality of projections, each of which is formed by at least one surface extending rectilinearly in said axial direction, each of said projections disposed on said external tube part having a radially innermost part thereof spaced from said outer surface of said axle part and each of said projections disposed on said axle part having a radially outermost part thereof spaced from said inner surface of said external tube part.

17. The core member of claim 16, wherein each of said projections on said external tube part has a trapezoidal cross-sectional shape formed by three surfaces extending rectilinearly in said axial direction, said trapezoidal cross-sectional shape being taken in a plane which is perpendicular to said axial direction.

18. The core member of claim 16, further comprising fins disposed on said webs, each of said fins having a flat surface facing said axle part and a semi-circular surface facing said external tube part.

19. The core member of claim 16, further comprising fins disposed on said webs, each of said fins having at least one linear portion extending perpendicularly from a respective one of said webs.

20. The core member of claim 16, further comprising fins disposed on said webs, each of said fins having a pair of first linear portions extending perpendicularly from a respective one of said webs and second linear portions, each of which extends perpendicularly from a respective one of said first linear portions in a direction towards said axle part.

21. The core member of claim 16, wherein each of said projections on one of said axle part and said external tube part is formed by two surfaces extending rectilinearly in said axial direction, said two surfaces forming a V-shaped cross-sectional shape taken in a plane perpendicular to said axial direction.

22. The core member of claim 16, wherein each of said projections on said axle part is formed by one surface extending rectilinearly in said axial direction, said one surface forming a semi-circular cross-sectional shape taken in a plane perpendicular to said axial direction.

23. The core member of claim 16, wherein said axle part, said external tube part, said webs and said projections are integrally formed in one piece from the same material with air spaces formed between said axle part, said external tube part and said webs being open at opposite ends of said core member.

24. The core member of claim 23, wherein said material is selected from the group consisting of aluminum alloy, sintering material, synthetic resin, composite of synthetic resin and metallic fiber, composite of synthetic resin and carbon fiber and composite of synthetic resin and reinforcing fiber.

* * * * *